United States Patent [19]

Beane

[11] 4,369,860

[45] Jan. 25, 1983

[54] LADDER WITH BRACKET ATTACHMENTS

[76] Inventor: Tim E. Beane, 1008 Lima St., Wapakoneta, Ohio 45895

[21] Appl. No.: 212,379

[22] Filed: Dec. 3, 1980

[51] Int. Cl.[3] ..... E06C 7/48

[52] U.S. Cl. ..... 182/214; 248/210; 182/107

[58] Field of Search ..... 182/214, 107, 108; 248/210, 237, 236, 238, 235

[56] References Cited

U.S. PATENT DOCUMENTS

| | | | |
|---|---|---|---|
| 1,508,392 | 9/1924 | Heun | 182/214 |
| 2,605,950 | 8/1952 | Colvin | 403/63 |
| 3,318,416 | 5/1967 | Robinson | 182/214 |
| 3,486,580 | 12/1969 | Nameche | 182/214 |
| 3,653,462 | 4/1972 | Courtney | 182/214 |
| 3,853,202 | 12/1974 | Jarboe | 182/214 |
| 4,184,569 | 1/1980 | Grenier | 182/214 |
| 4,185,421 | 1/1980 | Robinson | 182/214 |

*Primary Examiner*—Reinaldo P. Machado
*Attorney, Agent, or Firm*—Bernard, Rothwell & Brown

[57] ABSTRACT

A ladder is provided with a pair of brackets which permit the ladder to be used against a house without damaging the gutters. The attachments comprise a pair of bracket members each of which is of square tubular construction and bent at approximately 20° midway between the ends thereof thus defining a horizontal leg and a depending leg. The horizontal leg of each bracket is attached to the top rung of a ladder. The opposite depending leg of each bracket has an extensible member threadedly engaged therein for inward or outward adjustment with respect thereto. A foot is carried on each extensible member which engages the inside rear wall of the gutter. The depending legs with the extensible members are positioned within the gutter with the feet thereof abutting against the inside rear wall thereof. The angle of bend of the brackets facilitates clearance of the depending legs above the top front edge of the front wall of the gutter and the extensible members adjustable to maintain the ladder away from the gutter thus preventing damage thereto.

9 Claims, 3 Drawing Figures

LADDER WITH BRACKET ATTACHMENTS

BACKGROUND OF THE INVENTION

1. Field of the Invention

This invention relates to ladders having brackets attached thereto which are used to prevent damage occuring to roof eave gutters in the event that the ladder is used to reach such gutters, roof trim or roof tops.

2. Statement of the Prior Art

Patents generally pertaining to this field of endeavor include the below listed, prior U.S. patents:

| Patentee | U.S. Pat. No. | Issue Date |
|---|---|---|
| W. M. Heun | 1,508,392 | Sept. 16, 1924 |
| E. H. Colvin | 2,605,950 | Aug. 5, 1952 |
| A. E. Nameche et al | 3,486,580 | Dec. 30, 1969 |
| Jarboe, deceased | 3,853,202 | Dec. 10, 1974 |
| Grenier | 4,184,569 | Jan. 22, 1980 |
| Robinson | 4,185,421 | Jan. 29, 1980 |

Of the above citations, reference is made to U.S. Pat. No. 4,185,421 which discloses a gutter protector assembly in the nature of an "H" shape support device which is permanently attached to the gutter back wall and serves to support a ladder thus preventing the ladder from pressing against the gutter. U.S. Pat. No. 3,853,202 discloses a safety device for use with ladders which finds particular application in preventing a ladder from slipping while it is in position against a roof. U.S. Pat. No. 3,486,580 shows a bracket device for use with ladders which is adapted to suspend the ladder away from the roof thus preventing damage to guttering and siding. U.S. Pat. No. 4,184,569 shows a ladder standoff bracket which is used to prevent damage to guttering. U.S. Pat. Nos. 1,508,392 and 2,605,950 also disclose brackets for use with ladders and are adapted to space the ladder away from the wall of a building.

SUMMARY OF THE INVENTION

The present invention involves the attachment of brackets to the rung of a ladder which are designed to prevent damage from occuring to roof eave gutters when the ladder is used to reach trim or roof tops. A pair of brackets in the nature of bent tubing defining horizontal and depending legs are attached at their horizontal ends to the rung of a ladder. The depending members having extensible members which facilitate adjustably positioning the depending members within a gutter without damaging the gutter front wall or the top edge thereof by the ladder. Feet members with pads thereon are attached to the ends of the extensible members and are designed to bite into the back wall of the gutter thus stabilizing the ladder.

One object of this invention is to provide a ladder with bracket attachments which will be inexpensive to produce and easy to install.

It is another object of this invention to provide brackets for a ladder having horizontal and depending legs which facilitate using the ladder against the roof without damaging the gutter.

It is a further object of this invention to provide a ladder with bracket attachments which have extensible ends adapted to adjustably support the ladder away from the gutter such that the gutter will not be damaged.

Other and further objects and advantages of the invention will become apparent to those skilled in the art from a consideration of the following specification when read in conjunction with the annexed drawing.

DESCRIPTION OF THE PREFERRED EMBODIMENT

Figure 1:
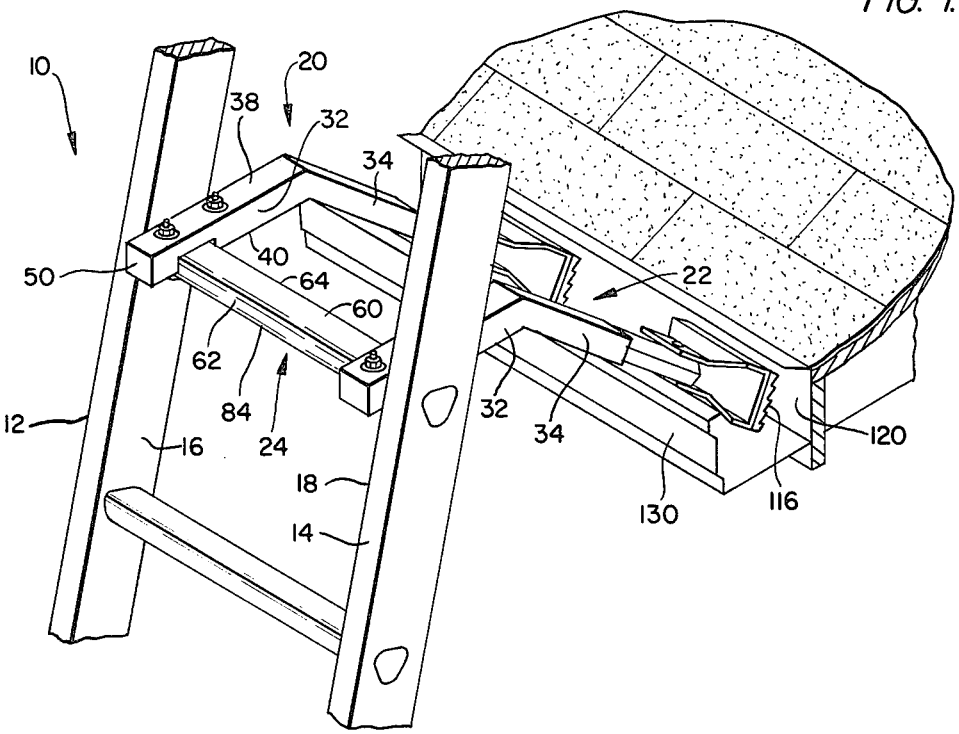
FIG. 1 is a perspective view of the ladder with a pair of brackets attached thereto.

Referring to the drawing in more detail, a ladder 10 is shown having side rails 12 and 14 and rungs 16 attached in the usual manner to the inside surfaces 16 and 18 of the side rails. Brackets 20 and 22 are shown attached to the top rung 24 as will be more fully explained below.

Figure 2:
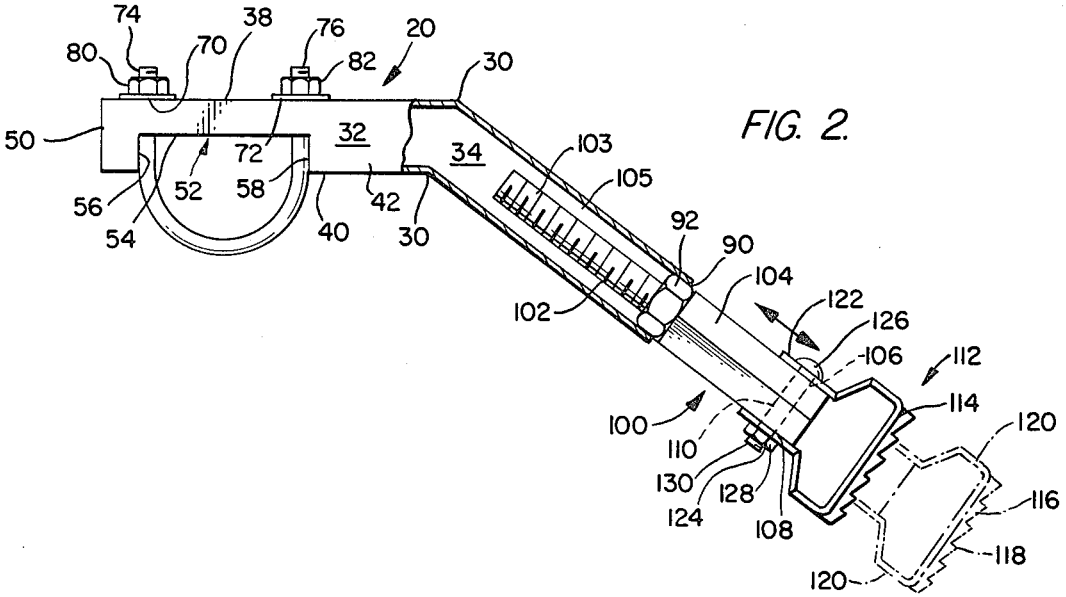
FIG. 2 is a side elevational view of one of the brackets.
Figure 3:
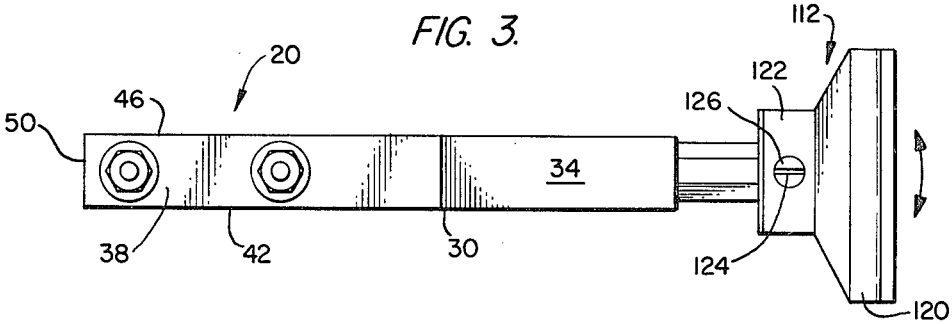
FIG. 3 is a top plan view of the bracket as shown in FIG. 2.

The brackets 20 and 22 are identical in construction and the detailed description of one is applicable to the other. In this regard, reference is directed to FIGS. 2 and 3 of the drawing wherein bracket 20 is shown to comprise a length of hollow aluminium tubing of square cross-section. The tubing is bent at 30 forming a horizontal leg 32 and a depending leg 34. The angle of the bend is approximately 20 degrees and occurs at the midpoint 36 between the ends of the tubing.

The horizontal leg 32 has top and bottom walls 38 and 40, side walls 42 and 46 and end wall 50. The bottom wall 40 and side walls 42 and 46 (one shown) are cut-out thus forming a slot 52. The slot 52 is circumscribed by inner edges 54 (one shown) and depending edges 56 and 58. The inner edges 54 of the brackets and depending edges 56 and 58 define a seat which is complementary to and cooperates with the top surface 60 and side walls 62 and 64 of the rung 24 in interlocking fashion.

The top wall 38 of each horizontal leg has holes 70 and 72 drilled therethrough for reception of the threaded ends 74 and 76 of U-bolts 78. The U-bolts 78 are used to firmly secure the horizontal leg of each bracket to the rungs 24 by use of threaded nuts 80 and 82.

To secure the brackets to the rungs 24, the slots 52 are positioned against the rung 24. The U-bolts 78 encircle the rung with the threaded ends inserted through the holes 70 and 72. The bolts 80 and 82 are tightened to firmly secure the brackets to the rung. Since the top surface 60 and side walls 62 and 64 of the rung are complementary with the slot 52 a firm interconnection is provided which acts to prevent slippage of the brackets on the rung.

Depending leg 34 has an opening at the end 90 into which there is positioned a threaded hex nut 92 which may be secured within the opening by welding or the like. An extension member 100 is provided which is extensible into and out of the depending leg and comprises a threaded bar 102 having an upper end 103 extending into the interior 105 of the depending leg 34. The opposite end of bar 102 has a hex nut 104 threaded thereon. The hex nut 104 has holes 106 and 108 drilled therethrough in opposing relation. A similar hole is drilled through the bar as best seen at 110 in FIG. 2. A foot 112 is provided on the opposite end of the bar and comprises a flat surface 114 to which is attached a wall engaging pad 116. The wall engaging pad 116 has serrations at 118 which permit the foot to bite into the back wall 120 of the gutter thus stabilizing the ladder. The foot 112 further comprises side portions 120 which terminate in terminal ears 122. Ears 122 have holes 124 (one shown) bored therethrough. In assemblying the extensible member 100, the holes in the bar 102, hex nut 104 and ears 122 are aligned and a bolt 126 inserted therethrough. A nut 128 is turned onto the end 130 of the bolt 126 to securely hold the bar 102, hex nut 104 and foot 112 together. Thus assembled, the threaded end 103 of the bar is turned into the hex nut 92 within the end 90 of the depending number 34 thus providing means for adjusting the length of the brackets. Thus, the extensible members may be adjusted relative to the depending leg 34 by rotating the extensible assembly into or out of the depending member 34 through the interaction of the hex nut 92.

In operation, the ladder with the brackets attached thereto is positioned adjacent the gutter 130 with depending legs 34 and extensible members 100 positioned within the gutter 130. With the feet abutting against the back wall 120, the extensible members may be adjusted so that the ladder 10 is maintained away from the front wall 130 of the gutter. The padding attached to the feet members 120 have serrations 118 which bite against the back wall 120 of the gutter thus stabilizing the ladder 10.

Although the invention has been described in detail with respect to its construction and operation and its use for preventing damage to guttering, it is intended that the present disclosure of the preferred embodiment has been made only as an example and that numerous changes in the construction may be resorted to without departing from the spirit and scope of the invention claimed herein below.

What I claim is:

1. A ladder with bracket attachments comprising:

a pair of brackets for attachment to the rung of a ladder each having a horizontal leg and a depending leg;

each horizontal leg having top and bottom walls and side walls;

cut-out means on said bottom and said side walls defining slot means which seat on the rung of a ladder;

means cooperating with said slot means and said rung for securing each of said pair of brackets to said rung;

each depending leg having an open end with threaded means therein;

an extensible member threadedly received within said threaded means of each depending leg; and foot means secured to each extensible member for engagement against the inside wall of a gutter.

2. A ladder with bracket attachments as defined in claim 1, wherein:

each of said pair of brackets is of hollow tubular construction.

3. A ladder with bracket attachments as defined in claim 1, and:

said means for securing said pair of brackets to said rung comprises U-bolts.

4. A ladder with bracket attachments as defined in claim 1, wherein:

said threaded means within said open end of each depending leg comprises a hex nut welded therein.

5. A ladder with bracket attachments as defined in claim 1, and:

said extensible member comprises a bar having upper and lower threads thereon, one end of said bar extensible into and out of said depending leg, the opposite end of said bar having means for limiting inward rotation of said extensible member within said depending leg.

6. A ladder with bracket attachments as defined in claim 1, and:

each foot having a serrated pad thereon for engagement against the back wall of a gutter.

7. A ladder with bracket attachments as defined in claim 2, and:

said hollow tubular construction being square in cross-section.

8. A ladder with bracket attachments as defined in claim 2, and:

said tubular concentration being bent at a 20 degree angle midway from end to end thereof.

9. A ladder with bracket attachments as defined in claim 5, wherein:

said means for limiting inward rotation of said threaded bar comprising a hex nut turned onto the other end of said bar, said hex nut and said bar having holes therein in aligned configuration and each foot having ears with holes therein, means for securing said hex nut, said ears of said foot to said threaded bar such that the assembly defines an extensible member adopted to be threadedly adjusted into and out of said depending leg in unison.

* * * * *